United States Patent [19]

Marks

[11] Patent Number: 5,069,238

[45] Date of Patent: Dec. 3, 1991

[54] PIVOTABLE JOINT AND JOINT LOCKING MECHANISM FOR A FOLDABLE FRAME

[76] Inventor: Lloyd A. Marks, 727 Great Springs Rd., Bryn Mawr, Pa. 19010

[21] Appl. No.: 592,815

[22] Filed: Oct. 4, 1990

[51] Int. Cl.[5] ..... E04H 15/48

[52] U.S. Cl. ..... 135/109; 135/112; 248/284; 403/92; 403/157

[58] Field of Search ..... 135/109, 112, 101; 403/92, 96, 157, 161; 248/284, 291, 184, 185

[56] References Cited

U.S. PATENT DOCUMENTS

| | | | |
|---|---|---|---|
| 414,976 | 11/1889 | Harvey . | |
| 579,277 | 3/1897 | Lord et al. . | |
| 1,488,772 | 4/1924 | Altnow . | |
| 1,504,889 | 8/1924 | Hansen . | |
| 1,772,646 | 8/1930 | Strombeck . | |
| 1,846,496 | 2/1932 | Mills . | |
| 1,969,260 | 8/1934 | Dixon et al. . | |
| 2,185,588 | 2/1940 | Datz . | |
| 2,311,515 | 2/1943 | Bridge . | |
| 3,133,549 | 5/1964 | Severing . | |
| 3,792,777 | 2/1974 | Drake . | |
| 3,811,151 | 5/1974 | Kuemmerlin . | |
| 3,826,270 | 7/1974 | Hentges | 135/109 X |
| 4,066,089 | 1/1978 | Rainwater | 135/109 X |
| 4,077,418 | 3/1978 | Cohen | 135/109 X |
| 4,085,762 | 4/1978 | O'Brian et al. | 135/109 X |
| 4,140,141 | 2/1979 | Marks | 135/109 X |
| 4,666,327 | 5/1987 | Su | 403/96 X |
| 4,890,950 | 1/1990 | Yoo | 403/96 |

*Primary Examiner*—David A. Scherbel
*Assistant Examiner*—Lan Mai
*Attorney, Agent, or Firm*—Wigman & Cohen

[57] ABSTRACT

A pivotable joint and a joint locking mechanism for a foldable frame apparatus are disclosed. The joint comprises mating male and female joint members mounted to the ends of tubular frame members and pivotably connected together to form oppositely articulatable joints of a foldable frame useful for tent enclosures and the like. A one-piece joint locking mechanism made of wire is provided for locking the joint in its erected or folded positions.

20 Claims, 2 Drawing Sheets

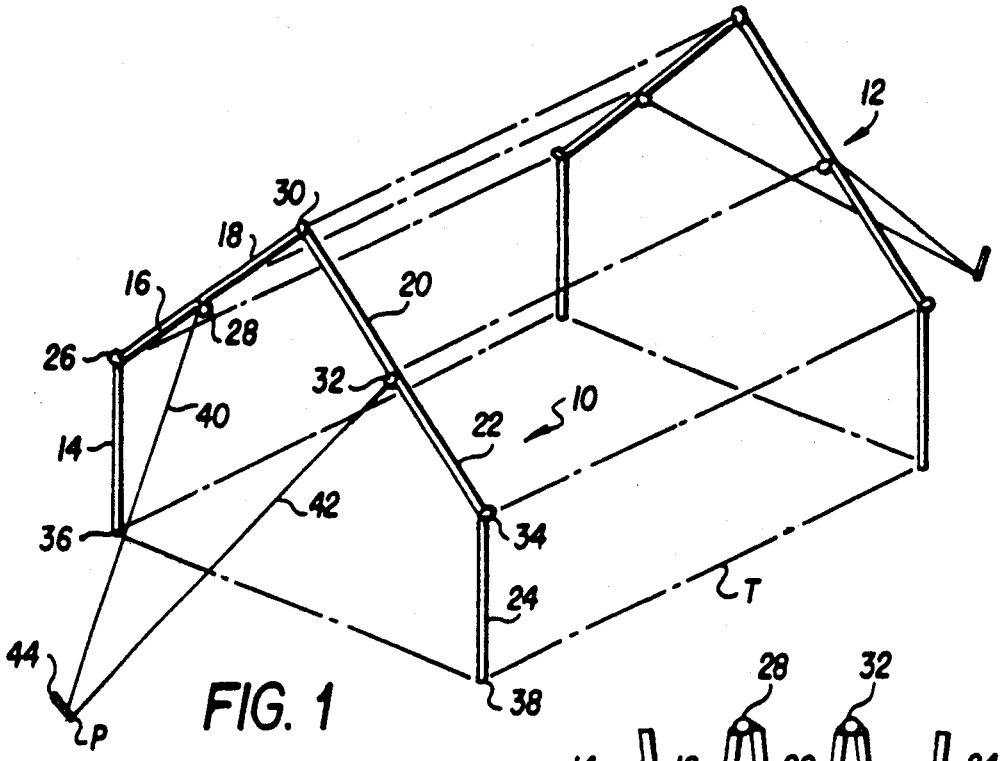
FIG. 1
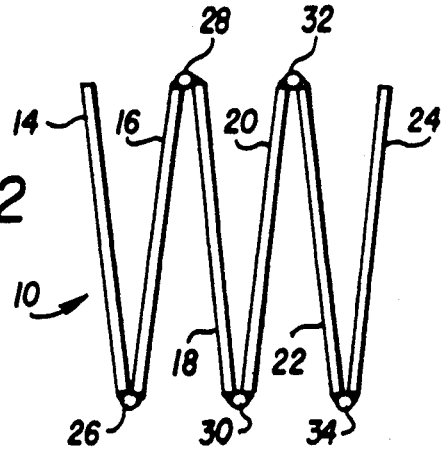
FIG. 2
FIG. 8
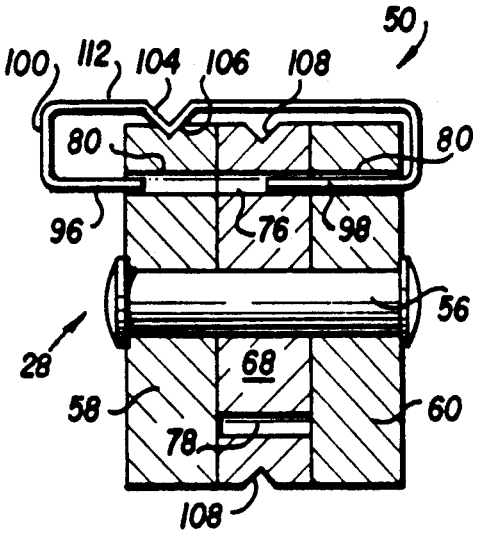
FIG. 9
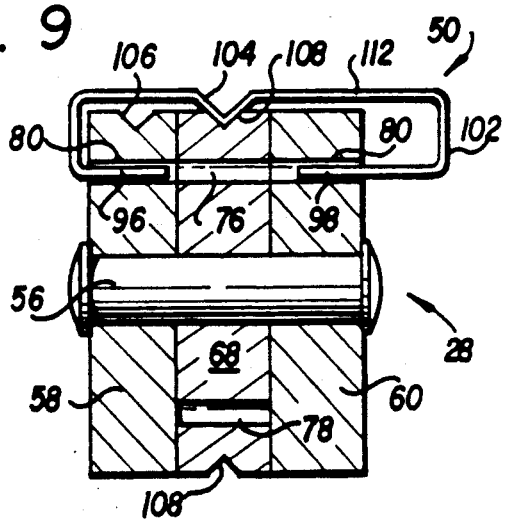

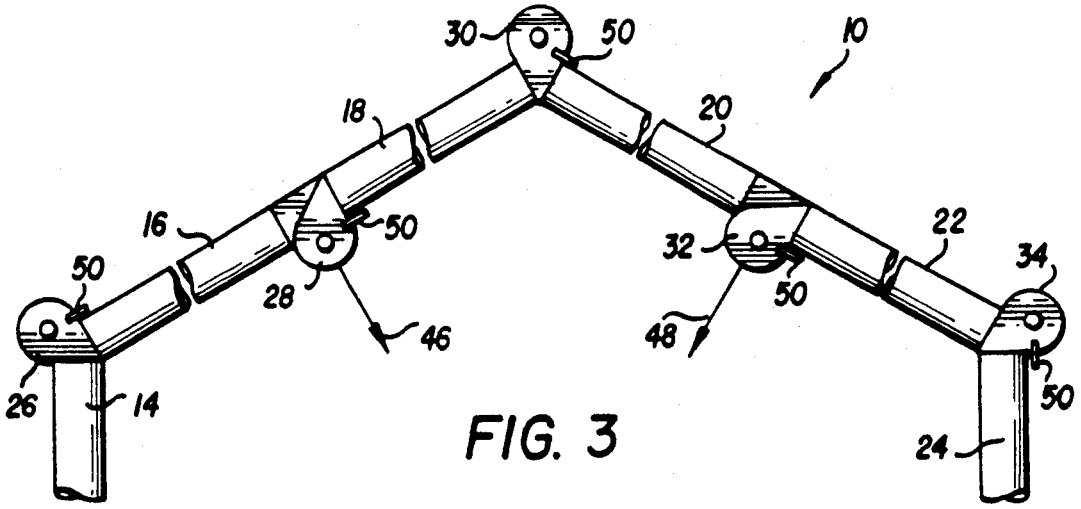
FIG. 3
FIG. 4
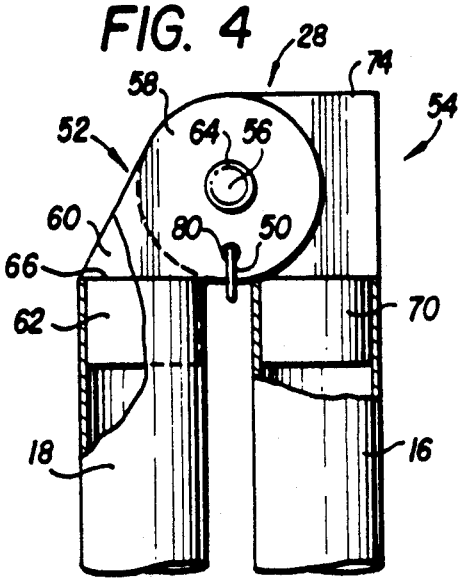
FIG. 5
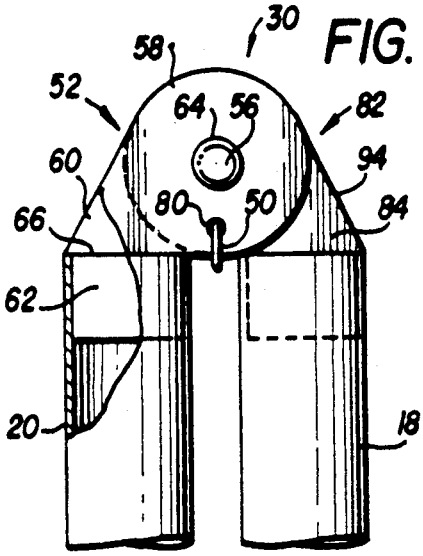
FIG. 6
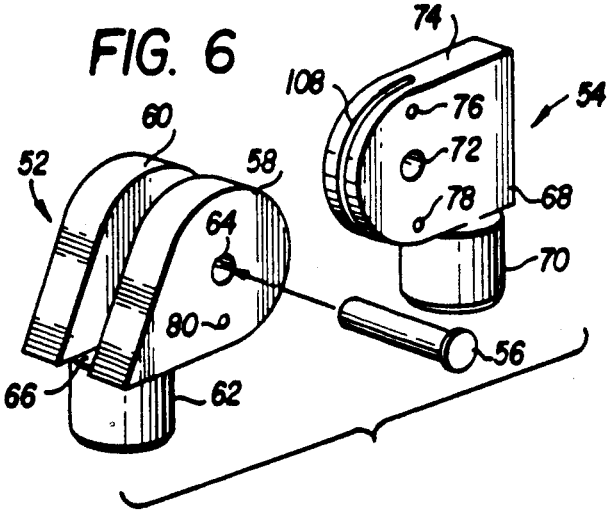
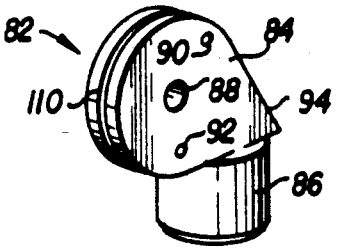
FIG. 7

PIVOTABLE JOINT AND JOINT LOCKING MECHANISM FOR A FOLDABLE FRAME

FIELD OF THE INVENTION

The present invention relates to a pivotable joint with a joint locking mechanism and more particularly to a joint locking mechanism for the joint members of a foldable frame structure for tents, shelters, temporary buildings and the like.

DESCRIPTION OF THE INVENTION

In my prior U.S. Pat. No. 4,140,141, the disclosure of which is incorporated herein by reference, there is described a foldable frame structure which is particularly useful for supporting flexible or semi-flexible enclosures, such as camping tents. That foldable frame structure has a plurality of elongate frame members which are connected together by pivotable joints. The pivotable joints are substantially flaccid when the frame is in its folded condition, but when the frame is erected, the joints are rigidified by a resilient tensile member.

It is also disclosed in my aforesaid patent that the pivotable joints of the foldable frame may be erected into a rigid support frame without the necessity of using joint locks, braces or other joint locking or rigidifying devices. External forces, such as wind, tend to further rigidify the frame and inhibit the collapse of the frame. Because of the rigidifying effect of the wind, for example, and because of the design complexity, unreliability and expense associated with prior art joint locking devices and other frame rigidifying means, it was considered an advantageous, albeit unclaimed, feature of my prior invention that the foldable frame structure could be erected into a rigid support frame without the need for means to lock the pivotable joints in their erected positions.

At wind velocities usually experienced in the field, the resilient joint rigidifying means of my prior foldable frame invention adequately prevents collapse of the rigidified joints of that foldable frame structure. However, extraordinary wind forces, such as might be experienced in high altitude camping, may exert sufficient force on the walls of an associated tent enclosure to overcome the resilient rigidifying force of one or more joints resulting in complete or partial collapse of the foldable frame supporting the tent enclosure. Moreover, external forces other than wind may be sufficient to collapse the frame. For example, a heavy snow or ice load on a tent supported by the frame might cause collapse of the frame. The inadvertent application of force to one or more of the resiliently rigidified joints of the frame by a person who may happen to fall or lean against the frame can also cause the frame to collapse.

In addition, I have found that folding of the oppositely articulated joints into its most compact folded condition is more effectively accomplished if the joints can be locked in their folded condition, especially in circumstances where the foldable frame is removed from the tent enclosure and folded separately from the tent enclosure.

In my prior patent, a number of prior art references were cited or made of record which disclose various types of devices for locking or rigidifying the joints of foldable frames for tent-like enclosures. For example, U.S. Pat. Nos. 414,976; 1,488,772; 1,772,646; 1,969,260; 2,185,588; 2,311,515; 2,473,076; and 3,826,270 disclose collapsible or portable houses or tent frames in which the pivotable or hinged joints of the frames are rigidified by braces or straps spanning the hinged joints. U.S. Pat. Nos. 1,504,889; 1,846,496; and 3,133,549 disclose foldable frames for tents or covers in which the pivotable joints of the frame are rigidified by various mechanisms which slide coaxially relative to the frame members.

A number of prior art joint locking devices are characterized by the use of a spring-biased locking pin engageable in mating holes in the joint when the joint is articulated to one or more predetermined angular positions. Examples of such devices are disclosed in U.S. Pat. Nos. 579,277; 3,792,777; 3,811,151; and 4,666,327.

U.S. Pat. No. 579,277, for example, discloses a pivotable joint for machinery, such as a bicycle handle, wherein the joint comprises a bifurcated joint member into which a disk-like joint member is inserted and pivotally connected by a hollow pintle in which spring-biased detent is carried. The detent is U-shaped and has at one end or leg thereof an enlarged portion which provides a push button against the bias of the spring. The other end or leg is engageable in mating openings in the bifurcated joint member and the disk-like joint to lock the pivotable joint in a given angular position.

U.S. Pat. Nos. 3,811,151 and 4,666,327 both disclose joints for foldable or collapsible ladders in which a spring-biased locking rod passes through a tubular pivot pin and engages in mating holes in the joint elements to lock the joint in a given angular position.

U.S. Pat. No. 3,792,777 discloses a locking device for a hinged equipment rack in which a spring-biased locking rod is engagable in one of a plurality of holes in a curved finger extending from the rack.

In general, the aforementioned prior art pivotable joint devices which employ spring-biased joint locking pins are relatively expensive and complex mechanisms comprising an assembly of a plurality of components. In addition, the articulatable joints of the prior art devices remain pivotable or in a non-rigidified condition until the joint locking mechanism has been engaged or operated either manually or by stored energy, such as a spring.

SUMMARY OF THE INVENTION

In view of the foregoing limitations and shortcomings of the prior art devices, as well as other disadvantages not specifically mentioned above, it should be apparent that there exists a need in the art for a pivotable joint with a locking mechanism suitable for use with a foldable frame which is characterized by a simple design and economical construction and, furthermore, which is particularly adapted for use with a self-rigidifying foldable frame of the type disclosed in my aforementioned U.S. Pat. No. 4,140,141. It is therefore a primary objective of the present invention to fulfill the need in the art by providing a foldable joint with a locking mechanism that is of simple, one-piece construction and is designed to lock the joint in either its fully folded position or its fully extended and erected position.

It is another object of the present invention to provide a pivotable joint that may be configured with different degrees of angular articulation for use in designing various arrangements of foldable frame structures.

The pivotable joint of the present invention comprises a pair of joint members pivotably connected to one another by a pivot means, such as a pin, rivet or the like. One of the joint members, described herein as a female joint member, comprises a bifurcated part including two spaced plates attached to a connector piece which is adapted to be mounted to an end of an elongate frame member. The other joint member, described herein as a male joint member, comprises a single plate also attached to a connector piece adapted to be mounted to an end of an elongate frame member. The plate of the male joint member is inserted into the bifurcated part, that is, between the spaced plates of the female joint member, and a pivot means is passed through mating holes in the plates of both joint members.

Because the alternating joints in the foldable frame apparatus disclosed in my aforesaid prior patent are oppositely articulatable, and also are articulatable to differing angular orientations, the joint members of the present invention are designed to be articulatable only through a predetermined angular arc depending on the particular frame configuration. For example, for foldable frames designed with four frame members similar to the frames shown in FIG. 1 of my aforesaid patent with a 90° angle between the frame members at the apex of the frame and a 135° angle between the frame members at either sidewall of the frame, three joint members are required, one of which is articulatable through only a 90° arc and two of which are identical and are articulatable through a 225° arc. For a foldable frame designed with six frame members each with a 135° angle between adjacent frame members, five joint members of only two different designs are required, namely, two joint members of one design articulatable through 135° and three joint members of another design articulatable through 225°. If adjacent frame members of a foldable frame are designed to lie along the same axis, i.e., with their longitudinal axes coincident, the joint member between them is designed to be articulatable through an 180° arc. Thus, a relatively few different designs of joint members having different degrees of angular articulation, e.g., 90°, 120°, 135°, 180°, 225°, and 240°, can be combined in various ways with a plurality of identical frame members to form foldable frames of widely varying sizes and shapes.

An important feature of the present invention is a joint locking mechanism which comprises a wire or rod bent generally into an elongated C-shape which may be described as a generally rectangular shape with one longer side of the rectangle comprising two legs of unequal length having free ends spaced from one another to form a gap intermediate said one longer side. The distance or gap between the free ends of the legs is slightly greater than the thickness of the plate of the male joint member. The legs of the one longer side of the rectangular wire locking device are guided in bores formed in the plates of the male and female joint members along axes parallel to the axis of the joint pivot means. The male joint member has a pair of bores each of which register with a coaxial pair of bores formed in the plates of the female joint member at a given position of articulation of the joint, i.e., fully folded or fully erected.

In one position of articulation of the joint member, e.g., the fully erected position, the appropriate bore in the male joint member is aligned or in registry with the pair of coaxial bores in the female joint member such that when the locking wire mechanism is urged in one direction parallel to the pviot axis of the joint to a locked position, the longer leg of the locking wire extends through the bore in one of the plates of the female joint member and a first one of the bores in the plate of the male joint member to thereby lock the plates together and prevent angular articulation therebetween. To release the joint locking mechanism, the locking wire is urged in the opposite direction parallel to the joint pivot axis to an unlocked position whereby the longer leg is urged completely out of the first bore in the plate of the male joint member thereby disengaging the plates of the male and female joint members so that they may be angularly articulated relative to one another.

The shorter leg of the locking wire is guided in the bore of the other plate of the female joint member and has a length equal to or shorter than the thickness of such plate. The shorter leg, therefore, cannot engage either bore in the male joint member regardless of the position of the locking wire, but merely functions to guide the movement of the locking wire and retain it on the plates of the joint members.

With the locking wire in the unlocked position, the male and female joint members may be angularly articulated to the fully folded position so as to align the coaxial bores in the female joint member with the second bore in the male joint member. The locking wire may then be urged to its locked position so that the longer leg of the locking wire extends through the bore in one of the plates of the female joint member and the second bore in the plate of the male joint member to lock the joint in the folded position of the frame members.

To aid in maintaining the locking wire in either of the two locked positions or in the unlocked position when the joint members are angularly articulated during erection of the foldable frame, the locking wire is provided with a deformed portion in the other longer side of the rectangular locking wire. The deformed portion is preferably a V-shaped detent in the wire, but may be a U-shaped detent or other irregularity in the wire. The peripheral edges of the plates of the male and female joint members are provided with appropriately positioned recesses for engaging the deformed portion of the locking wire when the locking wire is in its locked positions. The recesses prevent the inadvertent shifting of the locking wire to the unlocked position when the pivotable joint is locked in either the folded or erected condition.

Instead of the deformed portion of the locking wire engaging in detents or recesses in the joint members, other means for retaining the locking wire in its locked positions may be used such as frictional means between the locking wire and the joint member.

With the foregoing and other objects, advantages and features of the invention that may become hereinafter apparent, the nature of the invention may be more clearly understood by reference to the following detailed description of the invention, the appended claims and the several views illustrated in the attached drawings.

BRIEF DESCRIPTION OF THE DRAWINGS

FIG. 1 is a perspective view of a pair of foldable frames for a tent enclosure which utilize the pivotable joints and joint locking mechanism of the present invention;

FIG. 2 is an elevation view of the frames of FIG. 1 showing the manner in which the joints are oppositely articulated to fold the frame into a compact package;

FIG. 3 is a fragmentary elevation view of the foldable frame of FIG. 1 in the erected condition showing the manner in which the pivotable joints are connected to the frame members and locked in position by the locking mechanisms;

FIGS. 4 and 5 are fragmentary elevation views showing the two joint configurations which are used to construct the foldable frame of FIG. 3;

FIG. 6 is an exploded perspective view illustrating the joint member of FIG. 4 and the manner in which it is assembled;

FIG. 7 is a perspective view of the male joint member of the pivotable joint of FIG. 5;

FIG. 8 is a partial cross-sectional view of the joint member of FIG. 4 showing the locking mechanism in the locked position; and FIG. 9 is a partial cross-sectional view of the joint member of FIG. 4 showing the locking mechanism in the unlocked position.

DETAILED DESCRIPTION OF THE INVENTION

Referring now in detail to the drawings, there is illustrated in FIG. 1 a tent enclosure T shown in phantom lines and employing two foldable frames designated generally by reference numerals 10 and 12. Since the frames 10, 12 are identical, only one will be described in detail herein. Frame 10 comprises six elongate, rigid frame members 14,16,18,20,22,24 which are articulatingly connected to each other by pivotable connecting means or joints 26,28,30,32,34. As explained in more detail in my aforementioned prior patent, the frames 10 and 12 are preferably arranged outside the tent enclosure T, but may be arranged interiorly of the tent.

Joints 26,30 and 34 of frame 10 pivotally connect frame members 14–16, 18–20 and 22–24, respectively, so as to be inwardly articulatable. Joints 28 and 32 connect frame members 16–18 and 20–22, respectively, so as to be outwardly articulatable thereby making each adjacent joint oppositely articulatable so that the frame 10 can be folded into the compact configuration shown in FIG. 2.

The lowermost ends 36,38 of the frame members 14 and 24, respectively, are restrained from outward articulation by the tent enclosure T. Tensile members 40,42 are connected between the joints 28,32, respectively, and a fixed point P, such as a tent stake 44 so as to place the abutting end faces of all the joints in compression and thus rigidify the frame 10 according to the teachings of my prior patent.

FIGS. 3–7 illustrate in more detail the construction of the pivotable joint members connecting the frame members of foldable frame 10. In the foldable frame embodiment of FIGS. 1–3 two different designs of pivotable joints are required, namely, the 180° articulating joint of FIG. 4 and the 240° articulating joint of FIG. 5, it being understood that other joint designs are possible depending on the desired configuration of the foldable frame. For instance, a frame similar to that shown in FIG. 2 of my prior patent may be constructed with five joints, e.g., two 150° articulating joints and three 210° articulating joints. Other joint combinations and foldable frame configurations will be apparent to those skilled in the art in light of the teachings herein.

In the foldable frame 10 of FIG. 3, it can be seen that the frame comprises frame members 14,16,18,20,22 and 24 with the frame members 16–18 and 20–22 connected by joint members 28 and 32, respectively, each having a range of articulation limited to 180° (FIG. 4). Frame members 14–16, 18–20 and 22–24 are connected by joint members 26,30 and 34, respectively, each having a range of articulation limited to 240° (FIG. 5). As described above in connection with FIG. 1, forces applied to joint members 28 and 32 by tensile members in the directions shown by arrows 46,48 will rigidify the frame in its erected position and permit operation of the joint locking means 50 for each joint in the manner described hereinafter.

Referring now in particular to FIGS. 4 and 6, the construction of the 180° articulating joint 28 will be described. Joint 28 comprises a female joint member 52 and a male joint member 54 pivotally connected together by a pivot pin 56 of any suitable type. Joint member 52 comprises a pair of spaced plates 58,60 formed integrally with a cylindrical plug 62 sized to fit snugly in one end of the tubular frame member 18 (FIG. 4) and to be secured or bonded therein by means such as a rivet, pin, bolt or other suitable fastener (not shown). The plates 58,60 have a generally teardrop shape formed by a circular portion and a merging triangular portion with a bore 64 for receiving the pivot pin 56. Plates 58,60 are mounted to the plug 62 so that the axis of the bore 64 is offset from the longitudinal axis of frame member 18 a distance sufficient to permit the frame members 16,18 to be folded into a substantially parallel relation as shown in FIG. 4. The planar surface 66 formed at the upper end of plug 62 between the spaced plates 58,60 forms an abutment for limiting the degree of angular articulation of joint 28 as described hereinafter.

Male joint member 54 comprises a single plate 68 integrally formed with a cylindrical plug 70 identical to plug 62 for securing the joint member 54 to the tubular frame member 16. Plate 68 has a shape formed by merging a semicircular portion with a rectangular portion as best seen in FIG. 6 with a bore 72 for receiving pivot pin 56. Bore 72 is also offset from the longitudinal axis of frame member 16 in the same manner and for the same reason as described for bore 64. Plate 54 has a planar abutment surface 74 which abuts the planar surface 66 of female joint member 52 when the frame members 16,18 are articulated counterclockwise and clockwise, respectively, through 180° from the folded position shown in FIG. 4 to the erected position shown in FIG. 3.

The plate 68 of male joint member 54 is provided with a pair of small bores 76,78 offset 180° from each other on opposite sides of the bore 72. The small bores 76,78 align or register with a through bore 80 in the plates 58,60 of female joint member 52 for receiving the joint locking mechanism to be described hereinafter in connection with FIGS. 8 and 9.

FIGS. 5 and 7 illustrate the construction of the 240° articulating joint 30 which is identical to joints 26 and 34. Joint 30 comprises a female joint member 52 which is constructed identically to the female joint member 52 of FIG. 4 and a male joint member 82. Joint member 82 comprises a plate 84 integrally formed with a cylindrical plug 86 which fits and is secured in tubular frame member 18 in the same manner that plugs 62 and 70 are secured in their respective frame members. Plate 84 has a teardrop shape similar to the shape of plates 58 and 60 of the female joint member 52 and is provided with an offset bore 88 for receiving pivot pin 56 and smaller bores 90,92 for receiving the locking mechanism 50. The planar surface 94 of plate 84 is designed to abut planar surface 66 between the plates 58,60 and thereby limit the angular articulation of the joint to 240° from the folded position shown in FIG. 5 to the erected position shown in FIG. 3. The small bores 90,92 are angularly spaced 240° about the pivot axis to receive the locking mechanism 50 at the folded and erected positions of the joint.

From the foregoing it will be seen that all the joints 26,28,30,32,34 of frame 10 have the female joint member 52 as a common element and the design of the male joint member 54 or 82 determines the degree of articulation of the joint. Thus, greater flexibility and economy of frame configuration is possible since a plurality of different designs are necessary only for the the simpler male joint member to provide a wide variety of joints for use in many different frame configurations.

Referring now to FIGS. 8 and 9, there are shown partial cross-sectional views of the joint 28 illustrating the locked and unlocked conditions, respectively, of the joint 28 using the joint locking means or mechanism 50. Joint locking means 50 comprises a one-piece locking wire or rod, preferably of steel, bent into the generally rectangular, elongated C-shape shown in FIGS. 8 and 9. As shown, one long side of the locking wire has a gap therein so as to form two legs 96 and 98 of unequal length. Leg 98 is the longer leg and has a length less than the combined thicknesses of plates 60 and 68 so that it extends completely through the bore 80 in plate 60 and a substantial distance through bore 76 in plate 68 as shown in FIG. 8. The shorter leg 96 has a length equal to or slightly less than the thickness of plate 58 so that it is guided in bore 80 of of plate 58 regardless of the position of the locking wire 50, but does not extend into bore 76 of plate 68 in any position of the locking wire.

FIG. 8 shows the erected condition of the joint 28 seen in FIG. 3 with the frame members 16,18 extended along a common axis. In that position of angular articulation, the bore 76 in plate 68 is in registry with the bores 80 of the plates 58,60 and the leg 98 extends through the bore 80 in plate 60 and substantially through bore 76 to lock the plates against relative articulation in the position shown for joint 28 in FIG. 3.

To release the locking wire 50, the short end part 100 of the locking wire is manually urged to the right as viewed in FIG. 8 to the position shown in FIG. 9. In the FIG. 9 position, the leg 98 is retracted from the bore 76 in plate 68 and leg 96 extends only through bore 80 in plate 58 thereby unlocking plate 68 from plate 60 and permitting relative angular articulation to the position shown in FIG. 4. It will be appreciated that in the FIG. 4 position of the joint member plates, the bore 78 in plate 68 will be in registry with the bores 80 in plates 58 and 60 so that the locking wire 50 may manually urged to the left by pushing the other short end part 102 toward the position shown in FIG. 8 to thereby lock the plates 60 and 68 in the folded position shown in FIG. 4.

To retain the locking wire 50 in its locked or unlocked positions, the other long side 112 or third leg of the locking wire is provided with a V-shaped detent or deformation 104. Detent 104 is engageable in a V-shaped recess 106 in the periphery of plate 58 (FIGS. 8 and 9) to retain the locking wire 50 in the locked position shown in FIG. 8. Detent 104 is engageable in a V-shaped groove 108 in the periphery of plate 68 (FIGS. 6, 8 and 9) or a V-shaped groove 110 in the periphery of plate 84 (FIG. 7) to retain the locking wires 50 in the unlocked position shown in FIG. 9. Other forms of retention means may be utilized in lieu of the detent 104, recess 106 and grooves 108,110. For example, a material with a high coefficient of friction may be inserted between the long side 112 of the locking wire and the peripheries of the plates 58,60,68. A rubber sleeve (not shown), for example, may be provided over the long side 112 and frictionally bear against the plate peripheries.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A foldable frame comprising a plurality of frame members, a plurality of joint means for pivotally connecting the frame members together in end-to-end relation for articulation between a folded position and an erected position of the frame, tensile means operatively connected to said frame for rigidifying said joint means in the erected position of the frame, said tensile means comprising a longitudinally elastic tensile member and releasable locking means cooperating with each of said joint means for rigidly locking said joint means against articulation in at least the erected position of said frame, said locking means for each joint means comprising a one-piece locking member all parts of which are spaced from the pivot axis of the pivotable joint means associated therewith.

2. A frame according to claim 1, wherein said joint means comprise first and second joint members, said first and second joint members being pivotally connected for articulation about a pivot axis, said releasable locking means comprising a locking member having at least two positions, a first position in which said first and second joint members are locked against pivotable articulation and a second position in which said first and second joint members are pivotably articulatable with respect to one another, said locking member penetrating the joint members along only one axis.

3. A frame according to claim 2, wherein said locking member comprises at least one rigid leg member having a longitudinal axis parallel to and offset from the pivot axis of the joint members.

4. A frame according to claim 2, wherein said locking member comprises a one-piece rod member operatively connected to the first and second joint members in a position spaced from the pivot axis of the joint members.

5. A frame according to claim 2, wherein said locking member comprises a one-piece rod member, said rod member having first and second leg members arranged along the same axis, said first leg member being longer than said second leg member, said first and second joint members each having a bore, said first leg member being adapted to extend into both bores in the first position of the locking member and into only one of said bores in the second position of the locking member.

6. A frame according to claim 5, wherein said first and second joint members each comprise at least one plate, a pivot pin pivotally connecting said plates for articulation about the pivot axis, said bores being provided in said plates offset from the pivot axis, said rod member having a third leg spaced from and parallel to said first and second leg members, said third leg member extending externally of said plates.

7. A frame according to claim 6, including means cooperating between said locking member and said plates for retaining said locking member in a respective one of said first and second positions of the locking member.

8. A frame according to claim 6, wherein said first joint member comprises a pair of spaced plates, the plate of said second joint member being disposed between said pair of spaced plates, said second leg member extending into a bore in one of said pair of spaced plates.

9. A frame according to claim 5, wherein said second joint member has a second bore, said first leg member has a length sufficient to extend into the bore of the first joint member and into the second bore of the second joint member in the first position of the locking member to thereby rigidly lock the joint means in the folded position of the joint means.

10. A frame according to claim 2, including means cooperating between said locking member and said first and second joint members for retaining said locking member in a respective one of said first and second positions of the locking member.

11. A frame according to claim 2, wherein said locking member comprises a one-piece rod bent into an elongated, generally C-shaped configuration, said rod forming first and second legs of unequal length arranged along the same axis, a third leg parallel to said first and second legs and a pair of end parts, each of said end parts connecting said third leg with a respective one of said first and second legs.

12. A frame according to claim 1, wherein said releasable locking means rigidly locks said joint means against articulation in both the erected and folded positions of said frame.

13. A foldable frame comprising a plurality of frame members, a plurality of joint means for pivotally connecting the frame members together in end-to-end relation for articulation between a folded position and an erected position of the frame, tensile means operatively connected to said frame for rigidifying said joint means in the erected position of the frame, said tensile means comprising a longitudinally elastic tensile member and releasable locking means cooperating with each of said joint means for rigidly locking said joint means against articulation in at least the erected position of said frame, said joint means comprising first and second joint members, said first and second joint members being pivotally connected for articulation about a pivot axis, said releasable locking means comprising a locking member having at least two positions, a first position in which said first and second joint members are locked against pivotable articulation and a second position in which said first and second joint members are pivotably articulatable with respect to one another, said locking member comprising a one-piece rod member, said rod member having first and second leg members arranged along a common axis, said first leg member being longer than said second leg member, said first and second joint members each having a bore, said first leg member being adapted to extend into both bores in the first position of the locking member and into only one of said bores in the second position of the locking member, said first and second joint members each comprising at least one plate, a pivot pin pivotally connecting said plates for articulation about the pivot axis, said bores being provided in said plates offset from the pivot axis, said rod member having a third leg spaced form and parallel to said first and second leg members, said third leg member extending externally of said plates, and means cooperating between said locking member and said plates for retaining said locking member in a respective one of said first and second positions of the locking member, said retaining means comprising a detent on said third leg member and a recess or groove in at least one of said plates cooperating with said detent.

14. A joint locking device for a pivotable joint, said pivotable joint comprising first and second joint members, pivot means pivotally connecting said joint members for articulation about a pivot axis, releasable locking means cooperating with said joint members for rigidly and releasably locking said joint members against articulation about the pivot axis in at least one position of relative articulation between the joints, said locking means comprising a locking member spaced from and parallel to the pivot axis, said locking member penetrating the joint members along only one axis.

15. A joint locking device according to claim 14, wherein said first and second joint members each comprise at least one plate, each plate having a bore, said locking member comprising at least one rigid leg member movable between a first locked position extending into the bores in both plates and a second unlocked position extending into the bore of only one plate.

16. A joint locking device according to claim 15, including means cooperating between said locking member and said plates for retaining said locking member in a respective one of said first locked position and said second unlocked position.

17. A joint locking device according to claim 15, wherein said first joint member comprises a pair of spaced plates, the plate of said second joint member being disposed between the pair of spaced plates of the first joint member.

18. A joint locking device according to claim 14, wherein said locking member comprises a one-piece rod member bent into an elongated, generally C-shape, said rod member forming first and second legs of unequal length arranged along the same axis, a third leg parallel to said first and second legs and a pair of end parts, each of said end parts connecting said third leg with a respective one of said first and second legs.

19. A joint locking device according to claim 18, wherein said first and second joint members each comprise at least one plate, each plate having at least one bore, the locking member being movable parallel to the axes of said leg members and the pivot axis such that the longer of said first and second legs extends into a bore in the plate of each joint member in a first locked position of the joint locking device and extends into the bore in the plate of only one joint member in a second unlocked position of the joint locking device.

20. A joint locking device for a pivotable joint, said pivotable joint comprising first and second joint members, pivot means pivotally connecting said joint members for articulation about a pivot axis, releasable locking means cooperating with said joint members for rigidly and releasably locking said joint members against articulation about the pivot axis in at least one position of relative articulation between the joints, said locking means comprising a locking member spaced from and parallel to the pivot axis, said locking member being movable along its axis independently of the pivot means, said first and second joint members each comprising at least one plate, each plate having a bore, said locking member comprising at least one rigid leg member movable between a first locked position extending into the bores in both plates and a second unlocked position extending into the bore of only one plate and means cooperating between said locking member and said plates for retaining said locking member in a respective one of said first locked position and said second unlocked position, said retaining means comprising a detent on said locking member and a recess or groove in at least one of said plates cooperating with said detent.

* * * * *